US009070373B2

(12) United States Patent
Suzuki et al.

(10) Patent No.: US 9,070,373 B2
(45) Date of Patent: Jun. 30, 2015

(54) DECODING DEVICE, ENCODING DEVICE, DECODING METHOD, AND ENCODING METHOD

(75) Inventors: Masanao Suzuki, Yokohama (JP); Yohei Kishi, Kawasaki (JP); Miyuki Shirakawa, Fukuoka (JP); Shunsuke Takeuchi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 483 days.

(21) Appl. No.: 13/614,085

(22) Filed: Sep. 13, 2012

(65) Prior Publication Data

US 2013/0156112 A1 Jun. 20, 2013

(30) Foreign Application Priority Data

Dec. 15, 2011 (JP) ..... 2011-274599

(51) Int. Cl.
*G10L 21/038* (2013.01)
*G10L 25/90* (2013.01)

(52) U.S. Cl.
CPC ..... *G10L 21/038* (2013.01); *G10L 25/90* (2013.01)

(58) Field of Classification Search
USPC ..... 704/220, 500–504
See application file for complete search history.

(56) References Cited

U.S. PATENT DOCUMENTS 5,644,596 A * 7/1997 Sih ..... 375/232
8,898,057 B2 * 11/2014 Yamanashi ..... 704/205
2004/0078205 A1 4/2004 Liljeryd et al.
2006/0277038 A1 * 12/2006 Vos et al. ..... 704/219
2009/0006093 A1 * 1/2009 Das ..... 704/246
2009/0157413 A1 * 6/2009 Oshikiri ..... 704/501

FOREIGN PATENT DOCUMENTS

| | | |
|---|---|---|
| JP | 08-248897 | 9/1996 |
| JP | 3871347 | 1/2007 |
| JP | 2007-072264 | 3/2007 |
| WO | 2008/066071 | 6/2008 |

OTHER PUBLICATIONS

International Standard ISO/IEC 23003-1, Information technology—MPEG audio technologies—Part 1: MPEG Surround, Feb. 15, 2007 (57 pages).

(Continued)

*Primary Examiner* — Abul Azad
(74) *Attorney, Agent, or Firm* — Staas & Halsey LLP

(57) ABSTRACT

A decoding device to decode a main signal code obtained by encoding low-frequency components of an original signal and to output a lowband main signal for output of a main signal, includes: a processor; and a memory which stores a plurality of instructions, which when executed by the processor, cause the processor to execute, decoding auxiliary information code obtained by encoding auxiliary information, the auxiliary information being for generating, from the lowband main signal, a highband main signal corresponding to high-frequency components of the original signal; decoding residual code obtained by encoding low-frequency components of a residual signal indicating error components produced by encoding of the original signal, and thereby output a lowband residual signal; generating a highband residual signal indicating high-frequency components of the residual signal, based on the lowband residual signal output by the residual decoder and the output auxiliary information; generating an output signal.

12 Claims, 21 Drawing Sheets

(56) References Cited

OTHER PUBLICATIONS

Ralph Sperschneider, Text of ISO/13818-7:2005 (MPEG-2 AAC 4th edition), Audio Group, International Organization for Standardization ISO/IEC JTC1/SC29/WG11, Coding of Moving Pictures and Audio, Apr. 2005 (181 pages).

ISO/IEC14496-3:2005(E), 2005 (344 pages).

Japanese Office Action dated Apr. 21, 2015 in corresponding Japanese Patent Application No. 2011-274599 (4 pages) (1 page English Translation).

* cited by examiner

DECODING DEVICE, ENCODING DEVICE, DECODING METHOD, AND ENCODING METHOD

CROSS-REFERENCE TO RELATED APPLICATION(S)

This application is based upon and claims the benefit of priority of the prior Japanese Patent Application No. 2011-274599, filed on Dec. 15, 2011, the entire contents of which are incorporated herein by reference.

FIELD

The embodiments discussed herein relate to a decoding device, an encoding device, an encoding/decoding system, a decoding method, an encoding method, a computer-readable storage medium storing a decoding program, and a computer-readable storage medium storing an encoding program.

BACKGROUND

In recent years, MPEG Surround (ISO/IEC 23003-1:2007) standardized by international organization for standardization/international electrotechnical commission (ISO/IEC) has been adopted in multimedia broadcasting in Japan and digital television broadcasting service in foreign countries. The MPEG Surround involves forming main signal code by encoding an audio signal as an original signal, and forming residual code by encoding a residual signal which is indicative of error components produced by encoding of the original signal. FIG. 19 illustrates an example of a configuration of conventional technology for decoding input data encoded by a method as described above (i.e. coded data obtained by multiplexing the main signal code and the residual code together). In a decoding device 1000 illustrated in FIG. 19, input data is inputted to a data separator 1002 and separated into main signal code and residual code, which are then inputted to a main signal decoder 1004 and a residual decoder 1006, respectively. The main signal decoder 1004 decodes the main signal code to output a main signal. For example, when the main signal code is encoded by use of advanced audio coding (MC) or high-efficiency advanced audio coding (HE-AAC), an MC decoder or HE-AAC decoder for the used coding method is used as the main signal decoder 1004. Meanwhile, the residual decoder 1006 decodes the residual code to output a residual signal. For example, when the residual code is encoded by use of the MC or the like, an MC decoder for this coding method is used as the residual decoder 1006. The decoded main signal and residual signal are inputted to an adder 1008, which then adds these signals together to produce final output data. Such technologies are disclosed for example in Japanese Laid-open Patent Publication Nos. 8-248897 and 2007-72264, International Publication Pamphlet No. WO 2008/066071, and Japanese Patent No. 3871347.

Further, FIG. 20 illustrates an example of a configuration using the HE-MC as an encoding method for a main signal. In a decoding device 1001 illustrated in FIG. 20, input data is inputted to the data separator 1002 and separated into main signal code, auxiliary information code, and residual code, which are then inputted to a lowband main signal decoder 1010, an auxiliary information decoder 1012, and the residual decoder 1006, respectively. Here, the main signal code is a signal obtained by encoding low-frequency components of an original signal. The lowband main signal decoder 1010 decodes the main signal code to output a lowband main signal as lowband components of a main signal. Also, the auxiliary information decoder 1012 decodes the auxiliary information code to output auxiliary information.

In addition, through spectral band replication (SBR) technology, a highband main signal generator 1014 outputs a highband main signal formed of highband components of the main signal by using the auxiliary information and the lowband main signal. Description will now be given with regard to generation of the highband main signal in the highband main signal generator 1014. As illustrated in FIG. 21, the generation of the highband main signal is accomplished by selecting and replicating a predetermined frequency band of the lowband main signal, and making fine adjustments to electric power. Information indicating the predetermined frequency band to be selected, and gain for the fine adjustment of the electric power are contained in the auxiliary information. Then, a main signal synthesizer 1016 synthesizes the lowband main signal and the highband main signal to produce a main signal containing components in a full band. Therefore, the use of the SBR technology enables generating the highband main signal from the lowband main signal and the auxiliary information, and thus, obtaining the main signal code by encoding only the low-frequency components of the original signal, so that the encoding is possible even with low bit rate. Meanwhile, the residual decoder 1006 decodes the residual code by AAC-based or other decoding thereby to output a residual signal. Then, the adder 1008 adds the generated full-band main signal and the residual signal to produce final output data.

SUMMARY

In accordance with an aspect of the embodiments, a decoding device to decode a main signal code obtained by encoding low-frequency components of an original signal and to output a lowband main signal for output of a main signal, includes: a processor; and a memory which stores a plurality of instructions, which when executed by the processor, cause the processor to execute, decoding auxiliary information code obtained by encoding auxiliary information, the auxiliary information being for generating, from the lowband main signal, a highband main signal corresponding to high-frequency components of the original signal; decoding residual code obtained by encoding low-frequency components of a residual signal indicating error components produced by encoding of the original signal, and thereby output a lowband residual signal; generating a highband residual signal indicating high-frequency components of the residual signal, based on the lowband residual signal output by the residual decoder and the output auxiliary information; generating an output signal based on the main signal, the lowband residual signal and the highband residual signal.

In accordance with another aspect of the embodiments, an encoding device includes: a processor; and a memory which stores a plurality of instructions, which when executed by the processor, cause the processor to execute, outputting main signal code obtained by encoding low-frequency components of an original signal, and auxiliary information code obtained by encoding auxiliary information for generating a highband main signal corresponding to high-frequency components of the original signal, from a lowband main signal obtained by decoding the main signal code; and outputting residual code obtained by encoding low-frequency components of a residual signal indicating error components produced by encoding of the original signal, the auxiliary information with the high-frequency components of the original signal usable to generate a highband residual signal from a lowband residual signal from the residual code.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which.

DESCRIPTION OF EMBODIMENTS

Figure 1:
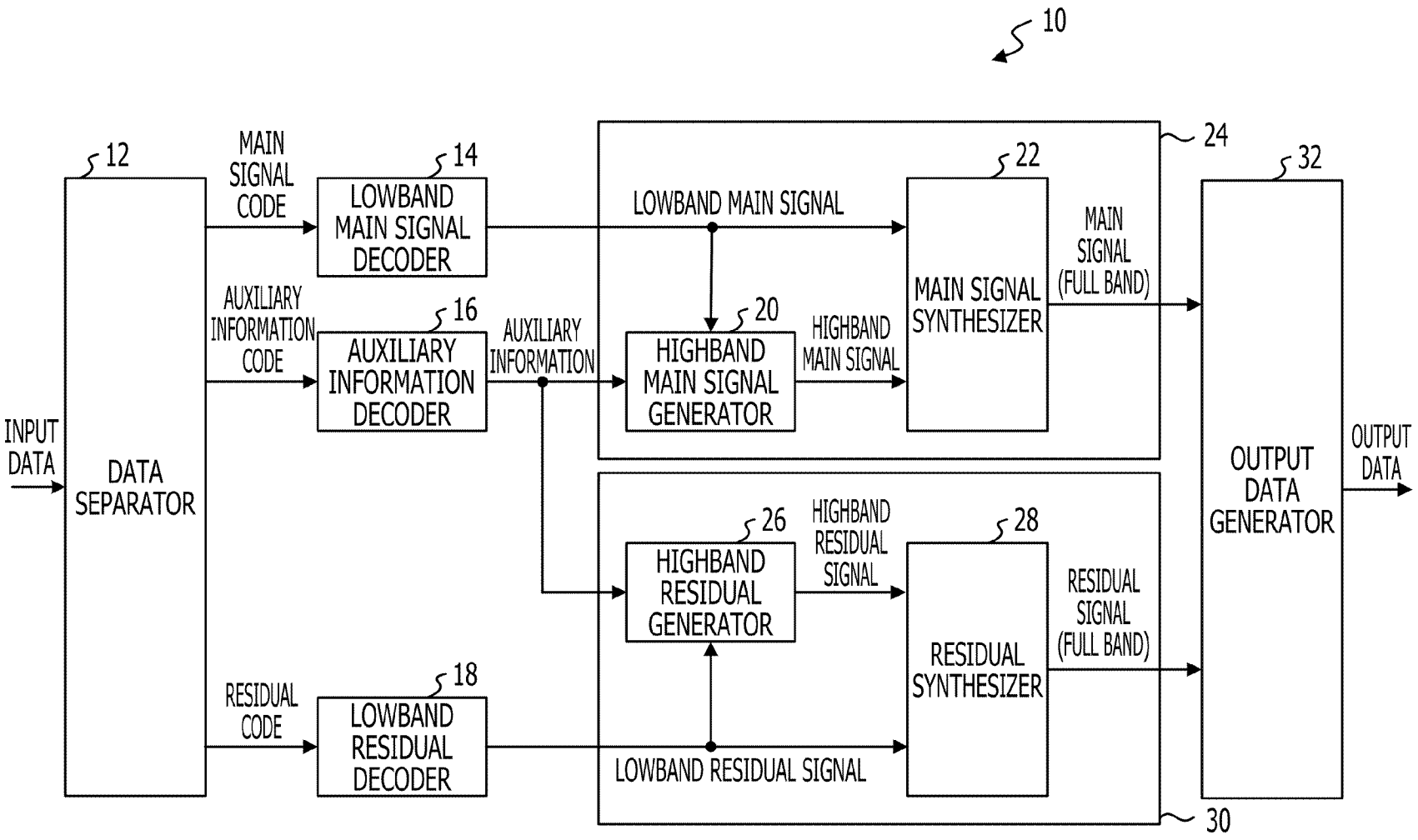
FIG. 1 is a functional block diagram of a decoding device according to a first embodiment.

FIG. 1 illustrates a decoding device 10 according to a first embodiment. The decoding device 10 performs a process for decoding input data to produce an output signal. The decoding device 10 may be represented as including a data separator 12, a lowband main signal decoder 14, an auxiliary information decoder 16, a lowband residual decoder 18, a main signal generator 24, a residual signal generator 30, and an output data generator 32. Further, the main signal generator 24 may be represented as including a highband main signal generator 20 and a main signal synthesizer 22. Also, the residual signal generator 30 may be represented as including a highband residual generator 26 and a residual synthesizer 28.

Figure 2:
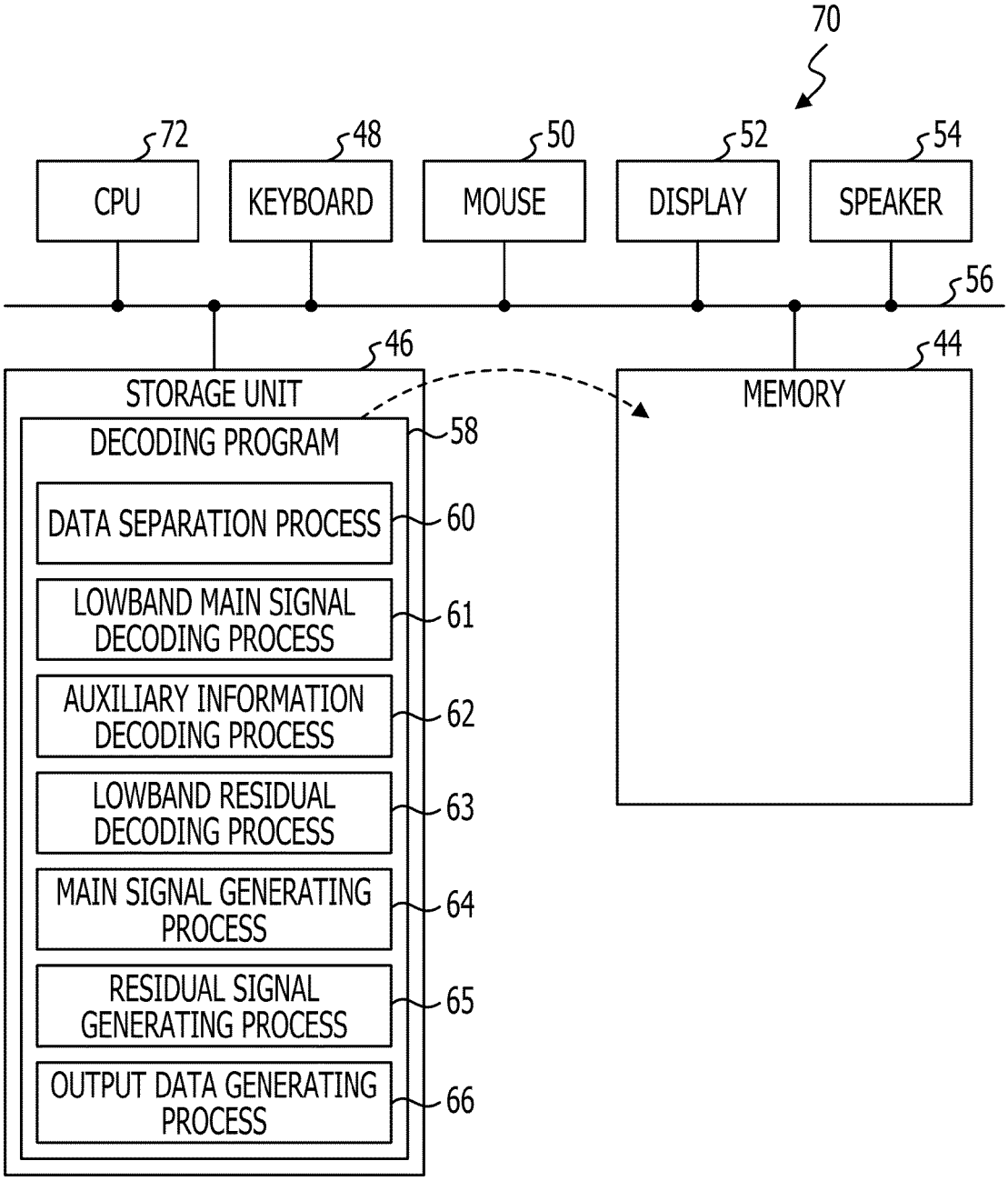
FIG. 2 is a schematic block diagram of a computer which functions as the decoding device.

The decoding device 10 may be implemented as a computer 70 illustrated for example in FIG. 2. The computer 70 includes a central processing unit (CPU) 72, a memory 44, a nonvolatile storage unit 46, a keyboard 48, a mouse 50, a display 52, and a speaker 54, which are interconnected through a bus 56. Incidentally, the storage unit 46 may be implemented as a hard disk drive (HDD) or a flash memory or the like. The storage unit 46 as a storage medium stores a decoding program 58 to cause the computer 70 to function as the decoding device 10. The CPU 72 loads the decoding program 58 from the storage unit 46 into the memory 44 and carries out sequential execution of processes included in the decoding program 58.

The decoding program 58 includes a data separation process 60, a lowband main signal decoding process 61, an auxiliary information decoding process 62, a lowband residual decoding process 63, a main signal generating process 64, a residual signal generating process 65, and an output data generating process 66. The CPU 72 executes the data separation process 60 to operate as the data separator 12 illustrated in FIG. 1. Also, the CPU 72 executes the lowband main signal decoding process 61 to operate as the lowband main signal decoder 14 illustrated in FIG. 1. Also, the CPU 72 executes the auxiliary information decoding process 62 to operate as the auxiliary information decoder 16 illustrated in FIG. 1. Also, the CPU 72 executes the lowband residual decoding process 63 to operate as the lowband residual decoder 18 illustrated in FIG. 1. Also, the CPU 72 executes the main signal generating process 64 to operate as the main signal generator 24 illustrated in FIG. 1. Also, the CPU 72 executes the residual signal generating process 65 to operate as the residual signal generator 30 illustrated in FIG. 1. Also, the CPU 72 executes the output data generating process 66 to operate as the output data generator 32 illustrated in FIG. 1. Thereby, the computer 70 on which the decoding program 58 is run functions as the decoding device 10.

Incidentally, the decoding device 10 may also be implemented for example as a semiconductor integrated circuit, more specifically an application specific integrated circuit (ASIC) or the like.

Figure 3:
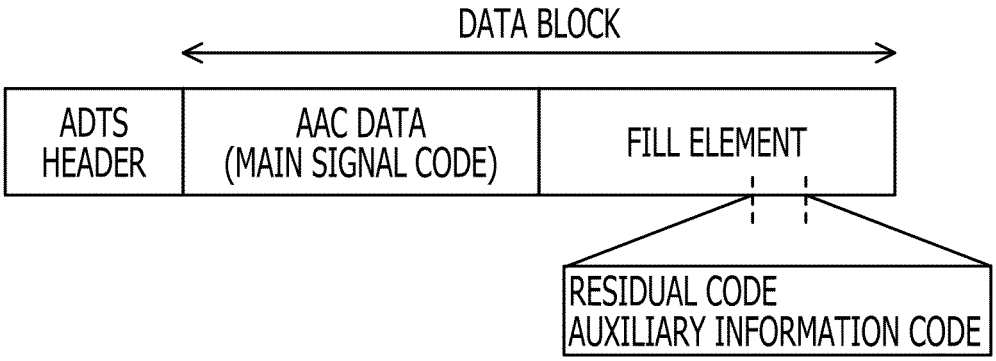
FIG. 3 is a schematic representation of an example of a format of input data.

The data separator 12 analyzes input data frame by frame and separates the multiplexed input data. Here, the input data is a signal obtained by multiplexing main signal code, auxiliary information code and residual code together. The main signal code is a signal obtained by encoding low-frequency components of an original signal. The auxiliary information code is a signal obtained by encoding auxiliary information for generating a highband main signal. The residual code is a signal obtained by encoding low-frequency components of a residual signal indicating error components produced by encoding of the original signal, i.e. an error between a main signal obtained by decoding the main signal code and the original signal. FIG. 3 illustrates a format of an input stream in MPEG Surround, as an example of the input data. The format illustrated in FIG. 3 is a data format called audio data transport stream (ADTS), and includes fields for an ADTS header, MC data, and a fill element. The MC data corresponds to the main signal code, and the residual code and the auxiliary information code are contained in the fill element. The input data obtained by multiplexing the signals together as described above is separated into the main signal code, the auxiliary information code, and the residual code. Incidentally, a method described in ISO/IEC 14496-3 standard, for example, may be used as a separation method. The main signal code also corresponds to another codec data, for example, AC-3 and DTS.

The lowband main signal decoder 14 decodes the main signal code separated by the data separator 12, by the MC, thereby to output a lowband main signal as lowband components of the main signal. Incidentally, a method described in ISO/IEC 13818-7 standard, for example, may be used for MC-based decoding.

The auxiliary information decoder 16 decodes the auxiliary information code separated by the data separator 12, thereby to output the auxiliary information. As illustrated in Table 1, the auxiliary information contains information indicating a predetermined frequency band selected from the lowband main signal, and information indicating gain for fine adjustment of electric power, involved in the generation of the highband main signal.

TABLE 1

| Sign | Meaning |
|---|---|
| F1 | Frequency at which source of main signal starts |
| F2 | Frequency at which source of main signal ends |
| F3 | Frequency at which target of main signal starts (F4-F3 = F2-F1) |
| F4 | Frequency at which target of main signal ends (F4-F3 = F2-F1) |
| Gain_sp | Power adjustment gain of main signal |

The lowband residual decoder 18 decodes the residual code separated by the data separator 12, by the MC, thereby to output a lowband residual signal as lowband components of the residual signal.

Figure 4:
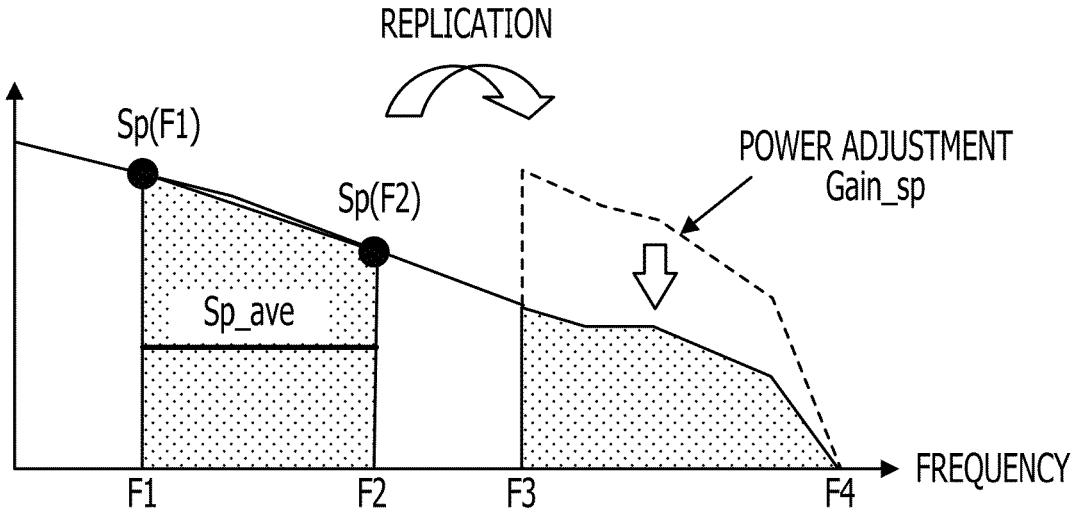
FIG. 4 is a schematic representation of assistance in explaining generation of a highband main signal.

Through the SBR technology, the highband main signal generator 20 generates the highband main signal as highband components of the main signal by using the lowband main signal outputted by the lowband main signal decoder 14 and the auxiliary information outputted by the auxiliary information decoder 16. The generation of the highband main signal, although it is the same as the above-described conventional technology, will be described with reference to FIG. 4, inclusive of a relationship with signs of the auxiliary information illustrated in Table 1. Firstly, the main signal code is obtained by encoding lowband frequencies 0 to F3 of the original signal, and is decoded by the lowband main signal decoder 14, which then outputs the lowband main signal between the frequencies 0 and F3. The highband main signal generator 20 extracts signals Sp(F1) to Sp(F2) in a range of the frequencies F1 to F2 of the lowband main signal by using the auxiliary information outputted by the auxiliary information decoder 16, and replicates the signals between the frequencies F3 and F4. Further, electric power of the replicated signals is adjusted by power adjustment gain Gain_sp. The signal between the frequencies F3 and F4 thus generated is the highband main signal.

The main signal synthesizer 22 synthesizes the lowband main signal decoded by the lowband main signal decoder 14 and the highband main signal generated by the highband main signal generator 20 thereby to produce a main signal containing components in a full band.

Using the SBR technology, the highband residual generator 26 generates a highband residual signal as highband components of the residual signal by using the lowband residual signal outputted by the lowband residual decoder 18 and the auxiliary information outputted by the auxiliary information decoder 16, i.e. the auxiliary information for the main signal (Table 1).

Figure 5:
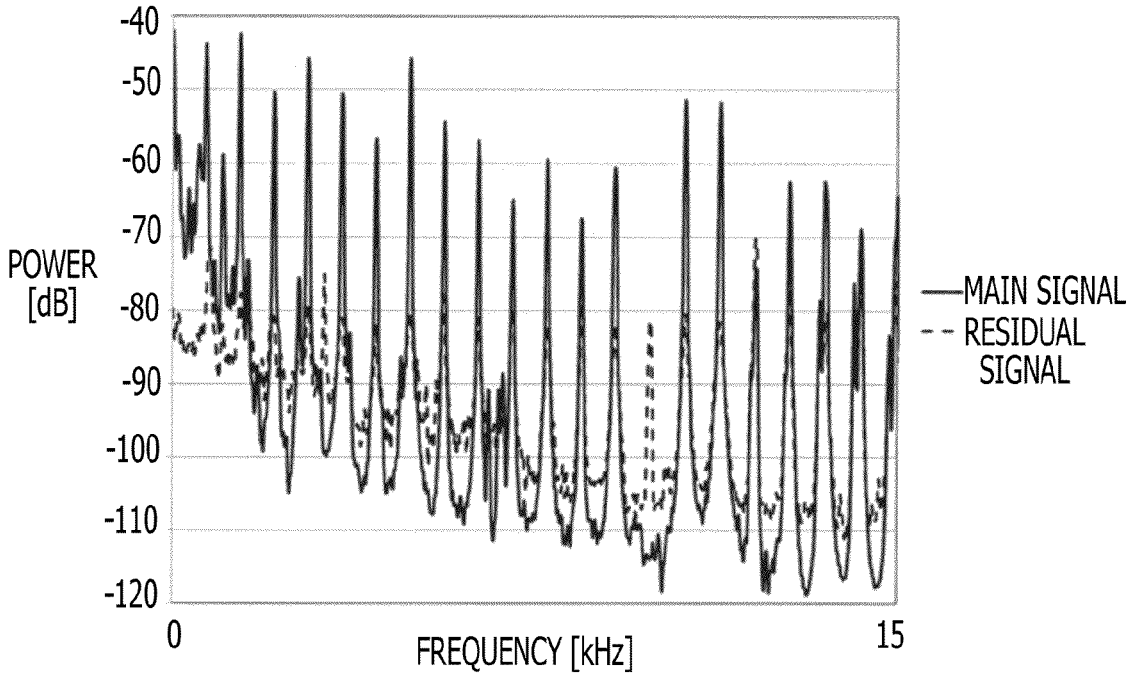
FIG. 5 is a graph illustrating an example of spectrum of tone of a harpsichord.

Here, description will be given with regard to the principle of generation of the highband residual signal using the lowband residual signal and the auxiliary information for the main signal. FIG. 5 illustrates an example of spectrum of tone of a harpsichord. As illustrated in FIG. 5, it is known that, in the case of sound containing many harmonic components, such as sound of musical instruments, there is a high correlation between lowband and highband main signals. Also, experiments made by the inventors have revealed that, when the MC is used to encode a main signal, many peak components are contained in lowband and highband residual signals and, hence, there is a high correlation between the lowband and highband residual signals. Also, it has been revealed that there is a high correlation between the main signal and the residual signal. Therefore, the generation of the highband residual signal from the lowband residual signal may be expected to reduce a bit rate for residual encoding. However, simple application of the conventional SBR technology to the residual signal may have to encode the auxiliary information for the residual signal. Therefore, the auxiliary information for the main signal is used to generate the highband residual signal from the lowband residual signal. Thereby, the encoding of the auxiliary information for the residual signal does not have to be performed.

According to the above-described principle, the highband residual generator 26 generates the highband residual signal by selecting and replicating a predetermined frequency band of the lowband residual signal indicated by the auxiliary information for the main signal, and making fine adjustments to electric power. Gain for power adjustment may be set to a value taking into account the correlation between the lowband main signal and the lowband residual signal and the correlation between the lowband residual signal and the highband residual signal. For example, the gain may be calculated from a ratio between average power of signals contained in the predetermined frequency band of the lowband main signal and average power of signals contained in the predetermined frequency band of the lowband residual signal. Also, besides the average power, a ratio between maximum or minimum values of signals contained in the respective predetermined frequency bands of the lowband main signal and the lowband residual signal, or the like may be used. Hereinbelow, description will be given specifically with regard to calculation of the gain using the average power ratio.

Figure 6:
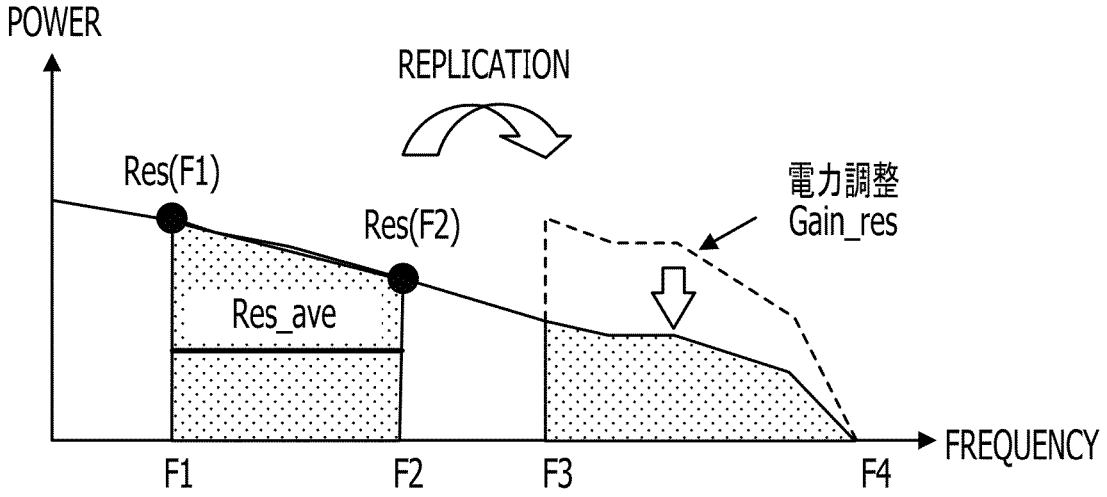
FIG. 6 is a schematic representation of assistance in explaining generation of a highband residual signal.

First, the highband residual generator 26 extracts signals Res(F1) to Res(F2) in the range of the frequencies F1 to F2 of the lowband residual signal as illustrated in FIG. 6, by using the auxiliary information outputted by the auxiliary information decoder 16. Also, lowband residual signal average power Res_ave is obtained by calculating an average of electric power of the extracted signals Res(F1) to Res(F2). Likewise, lowband main signal average power Sp_ave is obtained by calculating an average of electric power of the main signals Sp(F1) to Sp(F2) illustrated in FIG. 4. Power adjustment gain Gain_res for the residual signal is determined by Equation (1), using the calculated average power Res_ave and Sp_ave:

$$\text{Gain_res} = \beta \cdot \frac{\text{Res_ave}}{\text{Sp_ave}} \cdot \text{Gain_sp}, \ (0 \le \beta \le 1) \tag{1}$$

where β denotes a constant.

Then, for residual signal spectrum Res(f) of the signals Res(F1) to Res(F2), a compensation residual spectrum Res'(f) is determined by Equation (2).

$$Res'(f) = \text{Gain_}res \cdot Res(f), \ (f = F1, \ldots, F2) \tag{2}$$

Then, highband residual signal spectrum Res(F3) to Res(F4) is determined by Equation (3) effecting a frequency shift in the compensation residual spectrum Res'(F1) to Res'(F2).

$$Res'(F3 - F1 + f) = Res(f), \ (f = F1, \ldots, F2) \tag{3}$$

The residual synthesizer 28 synthesizes the lowband residual signal decoded by the lowband residual decoder 18 and the highband residual signal generated by the highband residual generator 26 thereby to produce a residual signal containing components in a full band.

The output data generator 32 adds the full-band main signal outputted by the main signal synthesizer 22 and the full-band residual signal outputted by the residual synthesizer 28 thereby to produce final output data. Incidentally, a method for generating output data is not limited to adding the main signal and the residual signal together.

Figure 7:
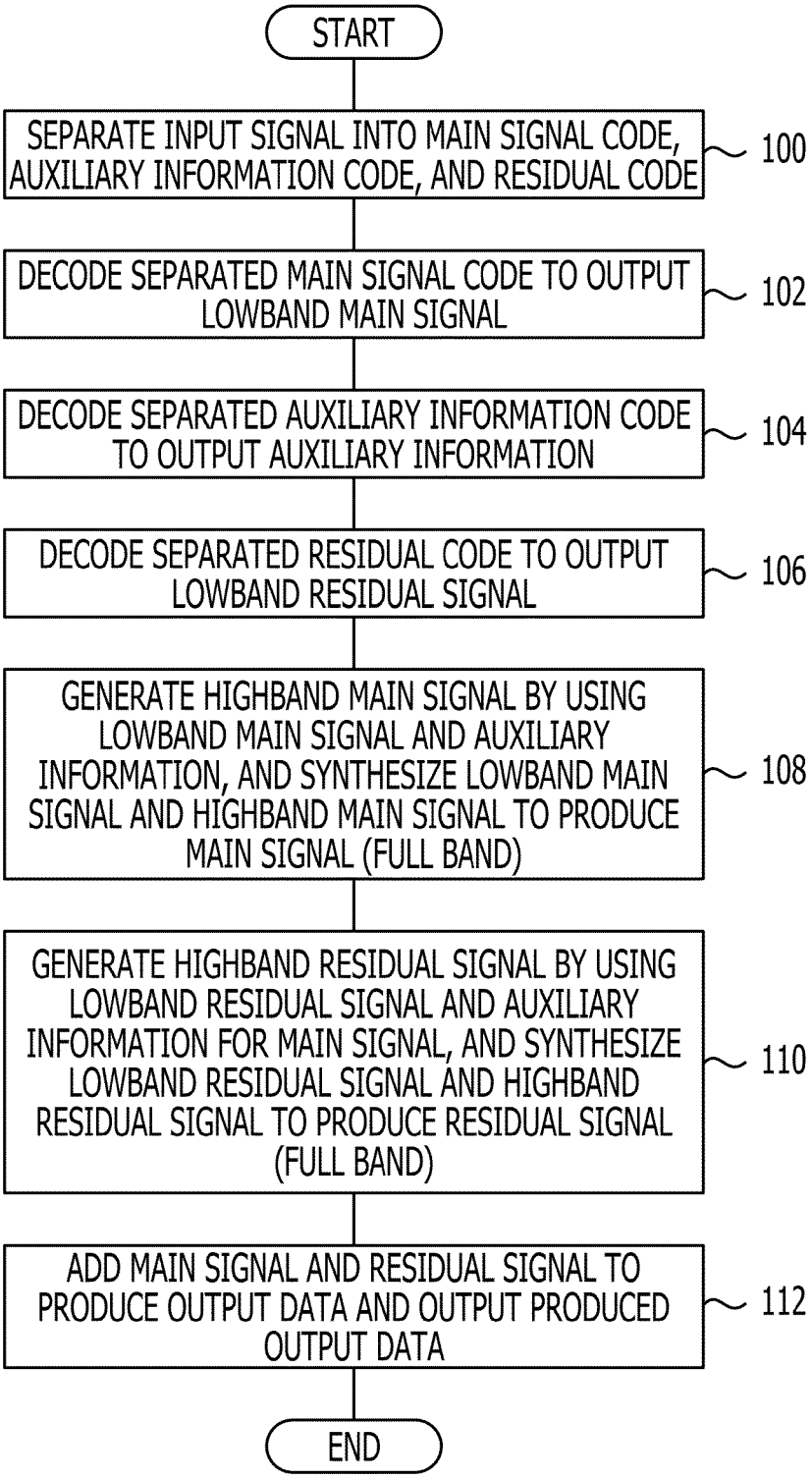
FIG. 7 is a flowchart illustrating details of a decoding process of the first embodiment.

Next, description will be given with reference to FIG. 7 with regard to the decoding process performed by the decoding device 10 of the first embodiment.

At step 100, the data separator 12 separates multiplexed input data into main signal code, auxiliary information code, and residual code.

Then, at step 102, the lowband main signal decoder 14 decodes the main signal code separated by the data separator 12, by the MC, thereby to output a lowband main signal as lowband components of a main signal.

Then, at step 104, the auxiliary information decoder 16 decodes the auxiliary information code separated by the data separator 12, thereby to output auxiliary information.

Then, at step 106, the lowband residual decoder 18 decodes the residual code separated by the data separator 12, by the MC, thereby to output a lowband residual signal as lowband components of a residual signal.

Then, at step 108, using the SBR technology, the highband main signal generator 20 generates a highband main signal as highband components of the main signal by using the lowband main signal outputted by the lowband main signal decoder 14 and the auxiliary information outputted by the auxiliary information decoder 16. Then, the main signal synthesizer 22 synthesizes the lowband main signal decoded by the lowband main signal decoder 14 and the highband main signal generated by the highband main signal generator 20 thereby to produce a main signal containing components in a full band.

Then, at step 110, using the SBR technology, the highband residual generator 26 generates a highband residual signal as highband components of the residual signal by using the lowband residual signal outputted by the lowband residual decoder 18 and the auxiliary information outputted by the auxiliary information decoder 16, i.e. the auxiliary information for the main signal. Then, the residual synthesizer 28 synthesizes the lowband residual signal decoded by the lowband residual decoder 18 and the highband residual signal generated by the highband residual generator 26 thereby to produce a residual signal containing components in a full band.

Then, at step 112, the output data generator 32 adds the full-band main signal outputted by the main signal synthesizer 22 and the full-band residual signal outputted by the residual synthesizer 28 thereby to produce final output data, and then the decoding process comes to an end.

As described above, the highband components of the residual signal are generated from the lowband components of the residual signal by the use of the auxiliary information for the main signal and the application of the SBR technology. Thus, a reduction in the bit rate for the residual signal may be achieved.

Figure 8:
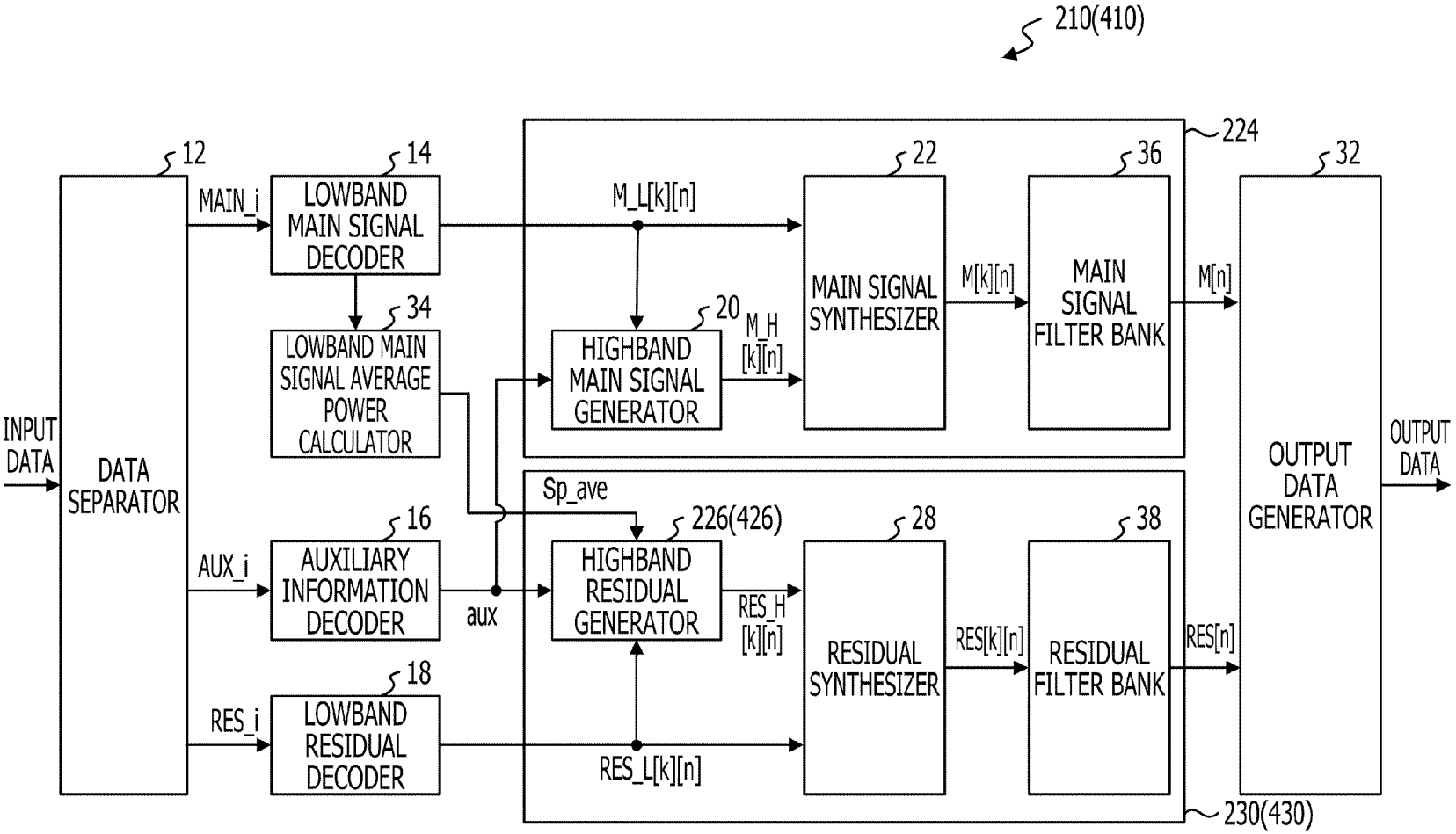
FIG. 8 is a functional block diagram of decoding devices according to second and fourth embodiments.

Next, a second embodiment will be described. FIG. 8 illustrates a decoding device 210 according to the second embodiment. Incidentally, the same parts as those of the decoding device 10 of the first embodiment are indicated by the same reference numerals, and detailed description of the same parts will be omitted.

The decoding device 210 of the second embodiment may be represented as including the data separator 12, the lowband main signal decoder 14, a lowband main signal average power calculator 34, the auxiliary information decoder 16, the lowband residual decoder 18, a main signal generator 224, a residual signal generator 230, and the output data generator 32. Further, the main signal generator 224 may be represented as including the highband main signal generator 20, the main signal synthesizer 22, and a main signal filter bank 36. Also, the residual signal generator 230 may be represented as including a highband residual generator 226, the residual synthesizer 28, and a residual filter bank 38.

The data separator 12 separates input data into main signal code MAIN_i, auxiliary information code AUX_i, and residual code RES_i.

The lowband main signal decoder 14 decodes the main signal code MAIN_i to output a lowband main signal M_L[k][n] ($0 \le k < K/2$, $0 \le n < N$), where K denotes a frequency bandwidth; and N, a time-domain frame length. For example, K may be set equal to 64 (K=64); and N, 128 (N=128). Also, the auxiliary information decoder 16 decodes the auxiliary information code AUX_i to output auxiliary information aux.

Figure 9:
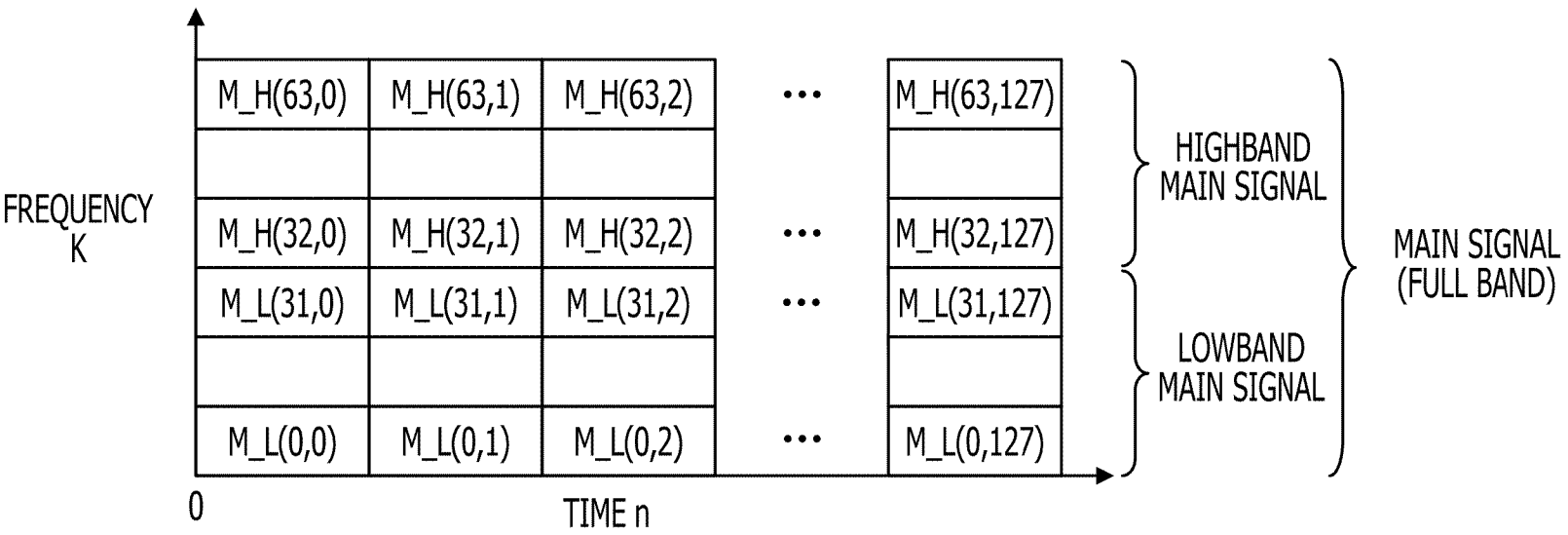
FIG. 9 is a schematic representation of relationships among a lowband main signal, a highband main signal, and a full-band main signal.

The highband main signal generator 20 generates a highband main signal M_H[k][n] ($K/2 \le k < K$, $0 \le n < N$) by using the lowband main signal M_L[k][n] and the auxiliary information aux. Also, the main signal synthesizer 22 synthesizes the lowband main signal M_L[k][n] and the highband main signal M_H[k][n] thereby to produce a full-band main signal M[k][n] ($0 \le k < K$, $0 \le n < N$). FIG. 9 illustrates relationships among the lowband main signal M_L[k][n], the highband main signal M_H[k][n], and the full-band main signal M[k][n].

The main signal filter bank 36 transforms the full-band main signal M[k][n] as the frequency-domain signal synthesized by the main signal synthesizer 22, into a time-domain main signal M[n], and outputs the time-domain main signal M[n]. Equation (4), for example, may be used as the filter bank.

$$IQMF[k][n] = \frac{1}{64}\exp\left(j\frac{\pi}{64}\left(k + \frac{1}{2}\right)(2n - 127)\right), \quad 0 \le k < 32, \ 0 \le n < 32 \tag{4}$$

The lowband residual decoder 18 decodes the residual code RES_i to output a lowband residual signal RES_L[k][n] ($0 \le k < K/2$, $0 \le n < N$).

As described for the process in the highband residual generator 26 of the first embodiment, the lowband main signal average power calculator 34 calculates lowband main signal average power Sp_ave from the lowband main signal M_L[k][n], and outputs the lowband main signal average power Sp_ave to the highband residual generator 26.

The highband residual generator 26 calculates lowband residual signal average power Res_ave from the lowband residual signal RES_L[k][n] in the same manner as the first embodiment. Then, a highband residual signal RES_H[k][n] ($K/2 \le k < K$, $0 \le n < N$) is generated by using the lowband residual signal RES_L[k][n], the auxiliary information aux, the lowband main signal average power Sp_ave, and the lowband residual signal average power Res_ave.

The residual synthesizer 28 synthesizes the lowband residual signal RES_L[k][n] and the highband residual signal RES_H[k][n] thereby to produce a full-band residual signal RES[k][n] ($0 \le k < K$, $0 \le n < N$). Relationships among the lowband residual signal RES_L[k][n], the highband residual signal RES_H[k][n], and the full-band residual signal RES[k][n] are the same as those illustrated in FIG. 9.

The residual filter bank 38 transforms the full-band residual signal RES[k][n] as the frequency-domain signal synthesized by the residual synthesizer 28, into a time-domain residual signal RES[n], and outputs the time-domain residual signal RES[n]. Equation (4) may be used as the filter bank.

The output data generator 32 adds the full-band main signal M[n] and the full-band residual signal RES[n] which have been transformed into the time-domain signals, thereby to produce final output data.

Incidentally, a decoding process by the decoding device 210 of the second embodiment merely includes the decoding process of the first embodiment (see FIG. 7), and, in addition, the processes for transforming the frequency-domain main and residual signals into the time-domain signals, following after steps 108 and 110, respectively, and therefore, description of the decoding process will be omitted.

As described above, the highband components of the residual signal are generated from the lowband components of the residual signal by the use of the auxiliary information for the main signal and the application of the SBR technology. Thus, a reduction in the bit rate for the residual signal may be achieved.

Figure 10:
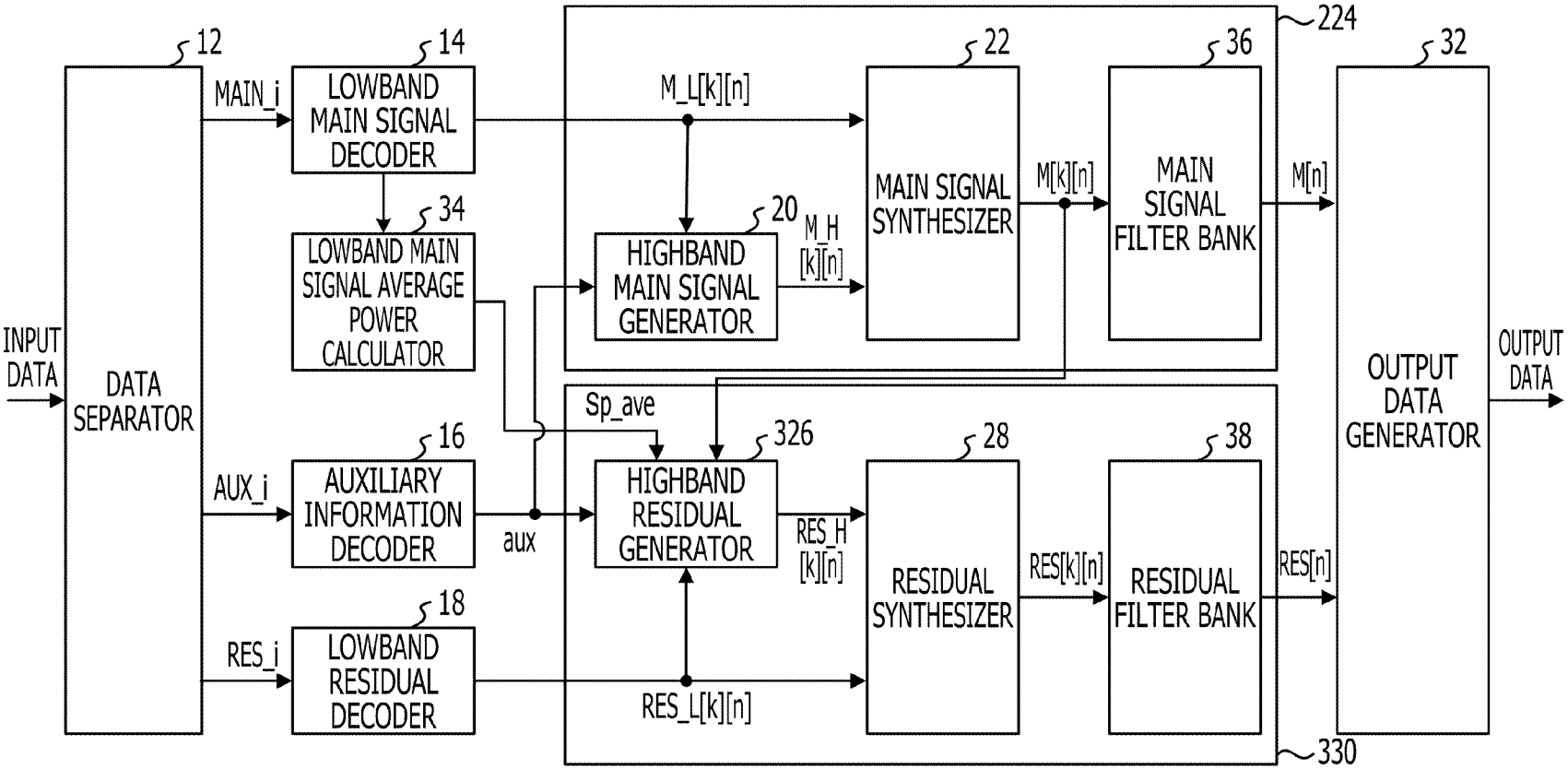
FIG. 10 is a functional block diagram of a decoding device according to a third embodiment.

Next, a third embodiment will be described. FIG. 10 illustrates a decoding device 310 according to the third embodiment. Incidentally, the same parts as those of the decoding device 10 of the first embodiment or the decoding device 210 of the second embodiment are indicated by the same reference numerals, and detailed description of the same parts will be omitted.

The decoding device 310 of the third embodiment may be represented as including the data separator 12, the lowband main signal decoder 14, the lowband main signal average power calculator 34, the auxiliary information decoder 16, the lowband residual decoder 18, the main signal generator 224, a residual signal generator 330, and the output data generator 32. Further, the main signal generator 224 may be represented as including the highband main signal generator 20, the main signal synthesizer 22, and the main signal filter bank 36. Also, the residual signal generator 330 may be represented as including a highband residual generator 326, the residual synthesizer 28, and the residual filter bank 38. A configuration of the decoding device 310 of the third embodiment is the same as that of the decoding device 210 of the second embodiment, except for the highband residual generator 326, and therefore, description will be given only with regard to the points of difference.

Generally, a sound source containing many harmonic components, such as sound of musical instruments, tends to have a high correlation between a lowband residual signal and a highband residual signal, and therefore, as described with reference to the first and second embodiments, the application of the SBR to the residual signal achieves the great effect of reducing the bit rate. On the other hand, as for a sound source having a low correlation between a lowband residual signal and a highband residual signal, the application of the SBR to the residual signal may lead to degradation in output data. Therefore, the decoding device 310 of the third embodiment controls operation of the highband residual generator 326, based on harmonic components contained in at least any one of a lowband main signal, a highband main signal, a full-band main signal, and a lowband residual signal. Incidentally, the reason for using at least any one of the lowband main signal, the highband main signal, the full-band main signal, and the lowband residual signal is that, when the residual signal contains many harmonic components, it is inevitable that the main signal also contains many harmonic components. In other words, whether the correlation between the lowband residual signal and the highband residual signal is high or low may be determined by evaluation of the harmonic components of at least any one of the lowband main signal, the highband main signal, the full-band main signal, and the lowband residual signal.

Figure 11:
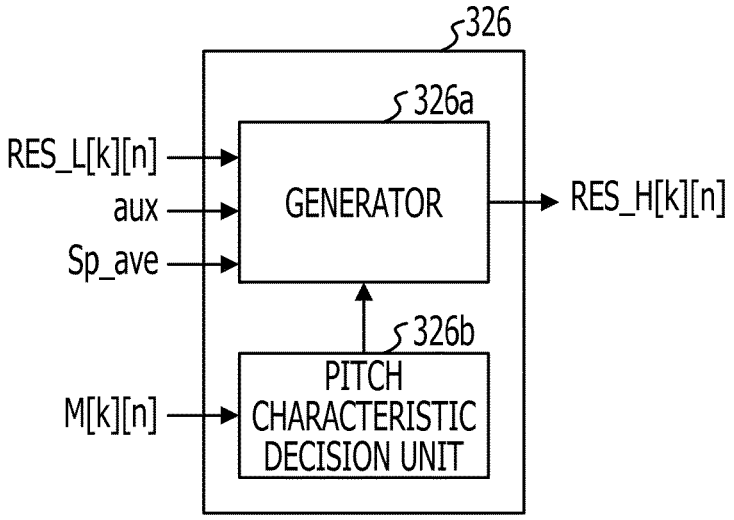
FIG. 11 is a functional block diagram of a highband residual generator of the third embodiment.

As illustrated in FIG. 11, the highband residual generator 326 may be represented as including a generator **326*a* and a pitch characteristic decision unit 326*b***.

The pitch characteristic decision unit **326*b* determines a pitch characteristic of the main signal M[k][n], based on the main signal M[k][n] coming in from the main signal synthesizer 22**. The pitch characteristic indicates the intensity of harmonic components contained in a signal. When the intensity of harmonic components contained in a signal is high, the signal is judged as having the pitch characteristic.

Specifically, the pitch characteristic decision unit **326*b*** determines a frequency-base autocorrelation Acor[n,d] of a frame of full-band main signal M[k][n] at each time n, for example by using Equation (5):

$$Acor[n, d] = \frac{\sum_{k=0}^{K-1-d} M[k][n] \cdot M[k+d][n]}{\sum_{k=0}^{k-1-d} M[k][n]^2} \tag{5}$$

where d denotes frequency-base delay.

Figure 12:
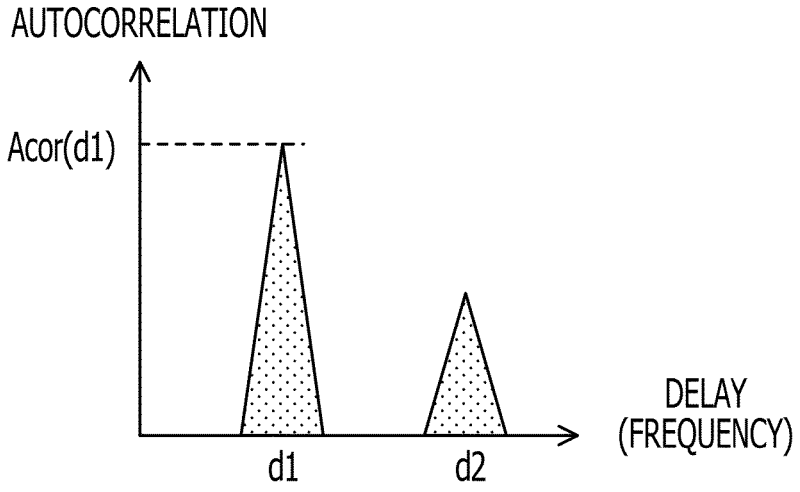
FIG. 12 is a schematic representation of an example of a frequency-base autocorrelation of a main signal.

By using the autocorrelation Acor[n,d] obtained for each time n, the sum, average, maximum value, minimum value or other values of the autocorrelations at all times (n=0, . . . , N) are determined thereby to determine an autocorrelation Acor [d] at all times for each delay d. For example, when the sum is used, the autocorrelation may be obtained for the delay d by the following equation: Acor[d]=Acor[0,d]+ . . . +Acor[N,d]. FIG. 12 illustrates an example of the autocorrelation Acor[d]. A maximum autocorrelation Acor[$d_{max}$] may be selected from among all autocorrelations Acor[d], for use as a parameter indicating the pitch characteristic. In the example of FIG. 12, an autocorrelation Acor[d1] is the autocorrelation Acor [$d_{max}$].

Also, when the calculated autocorrelation Acor[$d_{max}$] as the parameter indicating the pitch characteristic is equal to or more than a predetermined threshold value TH_pitch, the pitch characteristic decision unit **326*b*** determines that the main signal M[k][n] has the pitch characteristic. Meanwhile, when the autocorrelation Acor[$d_{max}$] is less than the threshold value TH_pitch, a decision is made that the main signal M[k][n] has no pitch characteristic.

When the pitch characteristic decision unit 326*b* determines that the main signal M[k][n] has the pitch characteristic, the generator 326*a* calculates the lowband residual signal average power Res_ave from the lowband residual signal RES_L[k][n] in the same manner as the highband residual generator 226 of the second embodiment. Then, the highband residual signal RES_H[k][n] is generated by using the lowband residual signal RES_L[k][n], the auxiliary information aux, the lowband main signal average power Sp_ave, and the lowband residual signal average power Res_ave. When the pitch characteristic decision unit 326*b* determines that the main signal M[k][n] has no pitch characteristic, the highband residual signal RES_H[k][n] is not generated. A method for controlling the generator 326*a* based on results obtained by the pitch characteristic decision unit 326*b* is illustrated in Table 2.

TABLE 2

| Acor[$d_{max}$] | Pitch characteristic of main signal | Generation of highband residual signal |
|---|---|---|
| Threshold value TH_pitch or more | Present | Generate |
| Less than threshold value TH_pitch | Absent | Not Generate |

Incidentally, when the generator 326*a* does not generate the highband residual signal RES_H[k][n], the residual synthesizer 28 outputs the lowband residual signal RES_L[k][n] alone. The residual filter bank 38 transforms the lowband residual signal RES_L[k][n] into a time-domain lowband residual signal RES_L[n]. Then, the output data generator 32 adds the full-band main signal M[n] and the lowband residual signal RES_L[n] thereby to produce final output data.

Figure 13:
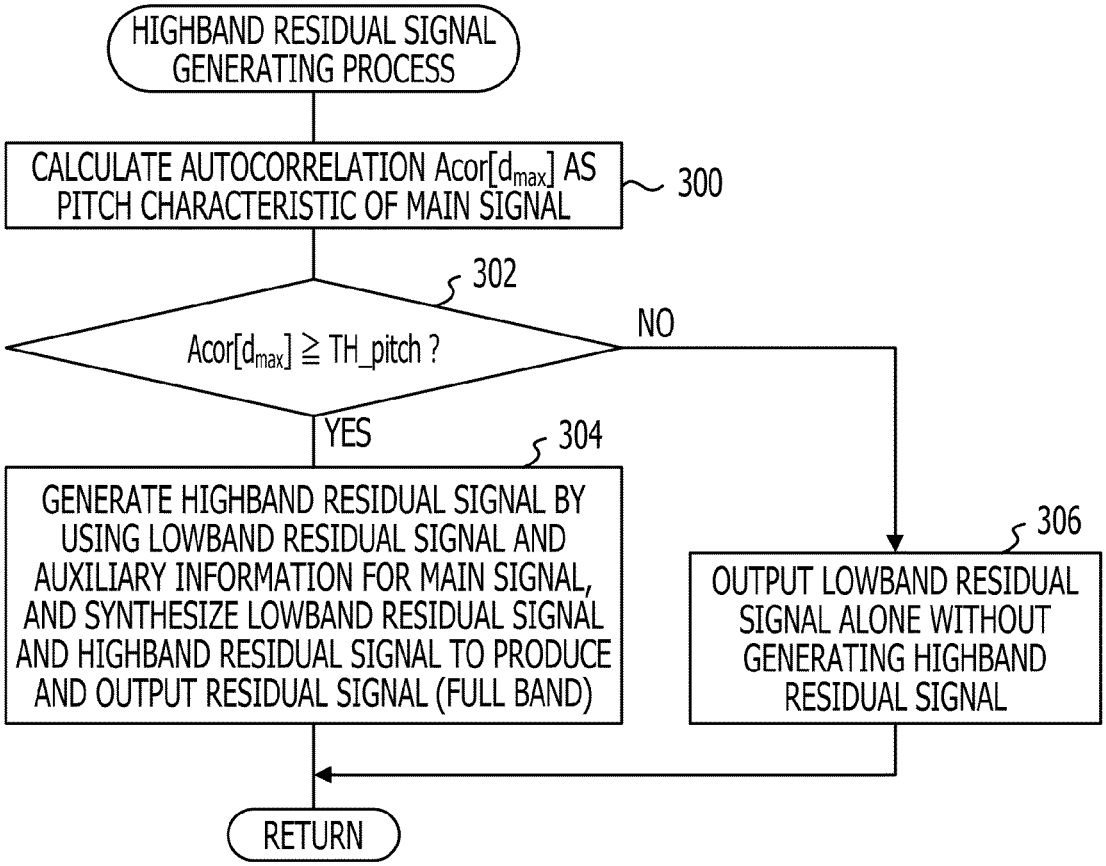
FIG. 13 is a flowchart illustrating details of a highband residual signal generating process of the third embodiment.

Next, description will be given with regard to a decoding process performed by the decoding device 310 of the third embodiment. The decoding process of the third embodiment includes a highband residual signal generating process illustrated in FIG. 13, which is executed in step 110 of the decoding process of the first embodiment (see FIG. 7).

At step 300, the pitch characteristic decision unit 326*b* calculates the maximum value Acor[$d_{max}$] of the frequency-base autocorrelation as the parameter indicating the pitch characteristic.

Then, at step 302, the pitch characteristic decision unit 326*b* determines whether or not the autocorrelation Acor [$d_{max}$] calculated at step 300 is equal to or more than the predetermined threshold value TH_pitch. When the autocorrelation Acor[$d_{max}$] is equal to or more than the threshold value TH_pitch (Acor[$d_{max}$]≥TH_pitch), a decision is made that the main signal M[k][n] has the pitch characteristic, and the processing goes to step 304. Meanwhile, when the autocorrelation Acor[$d_{max}$] is less than the threshold value TH_pitch (Acor[$d_{max}$]<TH_pitch), a decision is made that the main signal M[k][n] has no pitch characteristic, and the processing goes to step 306.

At step 304, the generator 326*a* calculates the lowband residual signal average power Res_ave from the lowband residual signal RES_L[k][n]. Then, the highband residual signal RES_H[k][n] is generated by using the lowband residual signal RES_L[k][n], the auxiliary information aux, the lowband main signal average power Sp_ave, and the lowband residual signal average power Res_ave, and the highband residual signal RES_H[k][n] is outputted.

At step 306, the generator 326*a* outputs the input lowband residual signal RES_L[k][n] alone without generating the highband residual signal RES_H[k][n].

As described above, whether or not to generate the highband residual signal is determined according to whether or not the main signal has the pitch characteristic, and thus, when there is a low correlation between the lowband and highband residual signals, degradation in output data may be suppressed.

Incidentally, in the third embodiment, description has been given with regard to an instance where the correlation between the lowband residual signal and the highband residual signal is determined based on the pitch characteristic of the main signal; however, the present disclosure is not so limited. As described above, the pitch characteristic of at least any one of the lowband main signal, the highband main signal, the full-band main signal, and the lowband residual signal may be evaluated.

Next, a fourth embodiment will be described. As illustrated in FIG. 8, a configuration of a decoding device 410 of the fourth embodiment is the same as that of the decoding device 210 of the second embodiment, except for a highband residual generator 426 included in a residual signal generator 430, and therefore, description will be given only with regard to the points of difference.

In generating a highband residual signal, the highband residual generator 426 of the fourth embodiment corrects power adjusted by the power adjustment gain Gain_res calculated by Equation (1).

Figure 14A:
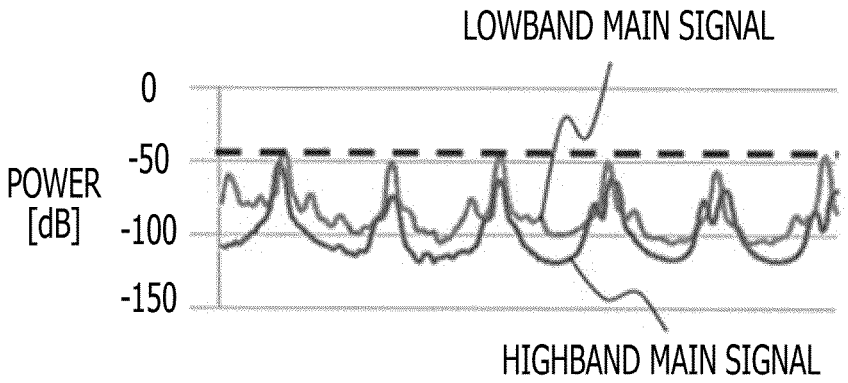
FIGS. 14A and 14B are schematic representations of comparison between lowband and highband main signals and comparison between lowband and highband residual signals, respectively.
Figure 14B:
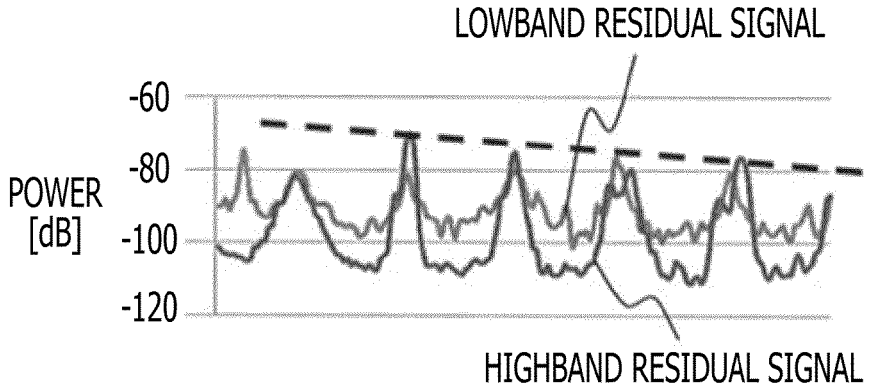

Here, description will be given with regard to the principle of power correction in the fourth embodiment. FIG. 14A illustrates an example of the lowband and highband main signals as represented in superimposed relation. In FIG. 14A, the lowband and highband frequencies, although ranging from F1 to F2 and from F3 to F4, respectively, are represented as superimposed for ready comparison. Also, FIG. 14B illustrates an example of the lowband and highband residual signals as represented in superimposed relation. In FIG. 14B, likewise, the lowband frequencies F1 to F2 and the highband frequencies F3 to F4 of the residual signals are represented as superimposed for ready comparison. Even if the lowband and highband main signals have substantially the same gradient of peak power relative to a change in frequency as illustrated in FIG. 14A, the highband residual signal may become lower in power than the lowband residual signal as illustrated in FIG. 14B. In such a case, when the lowband residual signal is replicated to form the highband residual signal and power adjustment is performed using power adjustment gain Gain_res such for example as is given by Equation (1), the power of the highband residual signal may become higher than an appropriate level, which in turn may lead to quality degradation in output data.

In the fourth embodiment, therefore, the highband residual generator 426 corrects the power of the generated highband residual signal so that the power is attenuated with increasing frequency.

Figure 15:
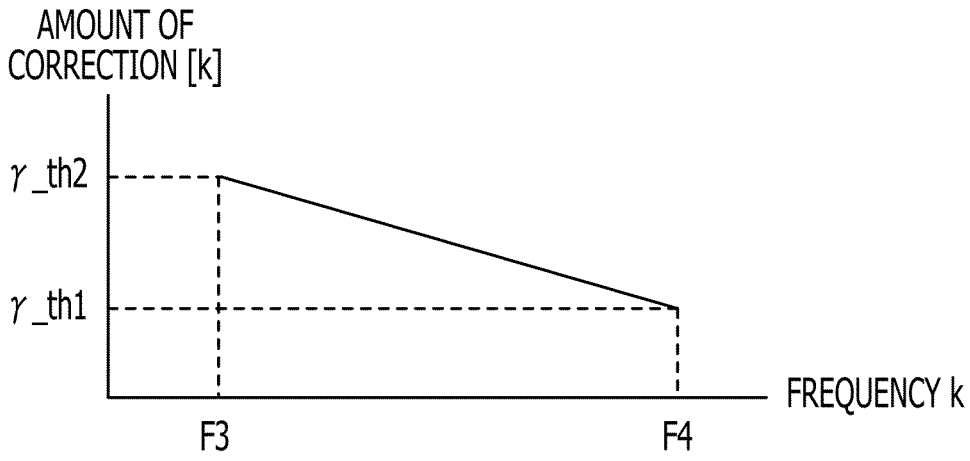
FIG. 15 is a schematic representation of an example of the amount of correction $\gamma$ for correction of a highband residual signal.

Specifically, the highband residual generator 426 corrects the highband residual signal RES_H[k][n] by multiplying the highband residual signal RES_H[k][n] generated by the same process as the second embodiment, by the amount of correction γ[k] illustrated in FIG. 15. The amount of correction γ[k] illustrated in FIG. 15 is a value which decreases at a certain rate between a constant γ_th1 corresponding to the frequency F3 at which the highband residual signal starts, and a constant γ_th2 corresponding to the frequency F4 at which the highband residual signal ends. For example, the constants γ_th1 and γ_th2 may be set equal to 1.0 (γ_th1=1.0, which causes no attenuation) and equal to 0.5 (γ_th2=0.5, which causes the power to decay to ½), respectively. The highband residual generator 426 corrects the highband residual signal RES_H[k][n] by Equation (6) by using the amount of correction γ[k], and outputs a corrected highband residual signal RES'_H[k][n].

$$RES'_H[k][n]=\gamma[k]\cdot RES_H[k][n],\ (K/2\leq k<K,\ 0\leq n<N) \tag{6}$$

Incidentally, a decoding process by the decoding device 410 of the fourth embodiment merely includes the decoding process of the first embodiment (see FIG. 7), and, in addition, the above-described power correction process, which is executed in step 110 of generating the highband residual signal, and therefore, description of the decoding process will be omitted.

As described above, the power of the highband residual signal is corrected so as to be attenuated with increasing frequency, and thereby, the power of the highband residual signal may be inhibited from becoming higher than an appropriate level, so that quality degradation in output data may be suppressed.

Incidentally, the constants γ_th1 and γ_th2 are not limited to the above-described values. Also, the amount of correction γ[k] has been described above as decreasing at a certain rate by way of example; however, any value may be used, provided only that the value may correct power so that the corrected power is attenuated with increasing frequency, and the amount of correction γ[k] may be set to a value such that nonlinear damping occurs.

Next, a fifth embodiment will be described. Although the decoding devices have been described with reference to the first to fourth embodiments, an encoding device will be described with reference to the fifth embodiment.

Figure 16:
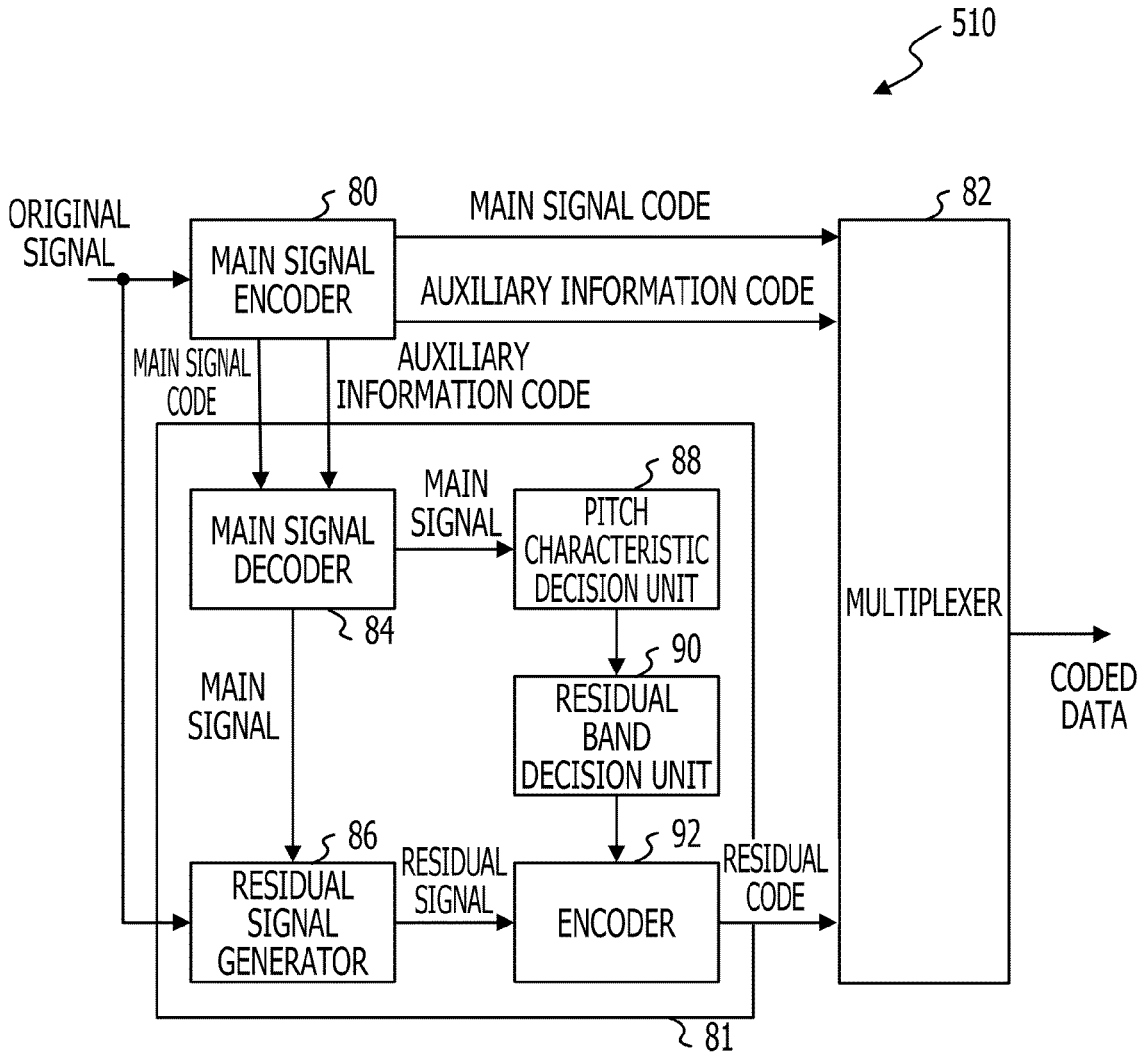
FIG. 16 is a functional block diagram of an encoding device according to a fifth embodiment.

FIG. 16 illustrates an encoding device 510 according to the fifth embodiment. The encoding device 510 performs a process for encoding an original signal to output coded data. The encoding device 510 may be represented as including a main signal encoder 80, a residual encoder 81, and a multiplexer 82. Further, the residual encoder 81 may be represented as including a main signal decoder 84, a residual signal generator 86, a pitch characteristic decision unit 88, a residual band decision unit 90, and an encoder 92.

Figure 17:
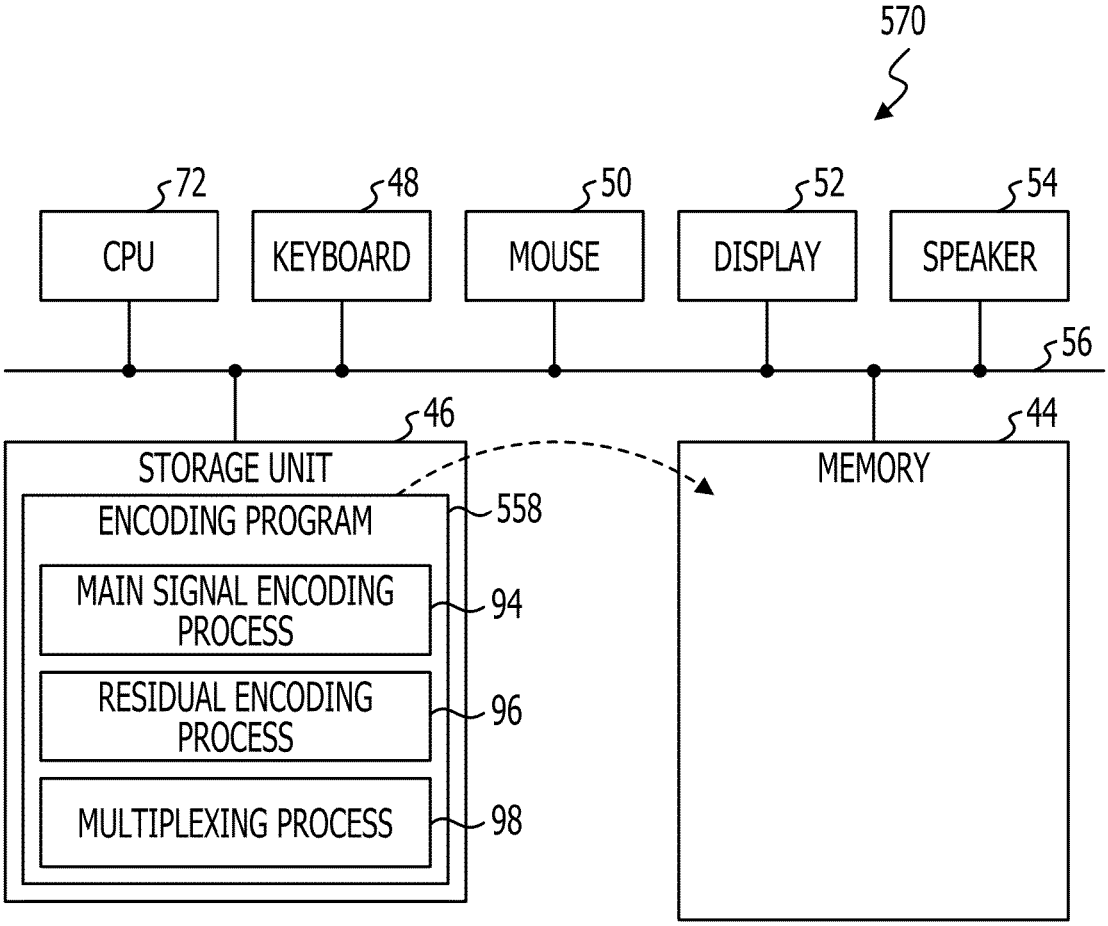
FIG. 17 is a schematic block diagram of a computer which functions as the encoding device.

The encoding device 510 may be implemented as a computer 570 illustrated for example in FIG. 17. As is the case with the computer 70 of the first embodiment, the computer 570 includes the CPU 72, the memory 44, the nonvolatile storage unit 46, the keyboard 48, the mouse 50, the display 52, and the speaker 54, which are interconnected through the bus 56. Incidentally, the storage unit 46 may be implemented as a hard disk drive (HDD) or a flash memory or the like. The storage unit 46 as a storage medium stores an encoding program 558 to cause the computer 570 to function as the encoding device 510. The CPU 72 loads the encoding program 558 from the storage unit 46 into the memory 44 and carries out sequential execution of processes included in the encoding program 558.

The encoding program 558 includes a main signal encoding process 94, a residual encoding process 96, and a multiplexing process 98. The CPU 72 executes the main signal encoding process 94 to operate as the main signal encoder 80 illustrated in FIG. 16. Also, the CPU 72 executes the residual encoding process 96 to operate as the residual encoder 81 illustrated in FIG. 16. Also, the CPU 72 executes the multiplexing process 98 to operate as the multiplexer 82 illustrated in FIG. 16. Thereby, the computer 570 on which the encoding program 558 is run functions as the encoding device 510.

Incidentally, the encoding device 510 may also be implemented for example as a semiconductor integrated circuit, more specifically an application specific integrated circuit (ASIC) or the like.

The main signal encoder 80 encodes an original signal by the HE-AAC to output main signal code and auxiliary information code. The HE-AAC is used for encoding, and thus, the main signal code is obtained by encoding low-frequency components of the original signal. Also, the auxiliary information code is information used for a decoding process to generate a highband main signal from a lowband main signal obtained by decoding the main signal code. Specifically, the auxiliary information contains information indicating a predetermined frequency band selected from the lowband main signal, and information indicating gain for fine adjustment of electric power, as described with reference to the first embodiment.

The main signal decoder 84 decodes the main signal code and the auxiliary information code encoded by the main signal encoder 80, thereby to output a main signal. Specific processing is the same as that performed by the main signal generator 24 of the first embodiment.

The residual signal generator 86 generates a residual signal indicating error components between the original signal and the main signal outputted by the main signal decoder 84.

The pitch characteristic decision unit 88 determines a pitch characteristic of the main signal decoded by the main signal decoder 84. Specifically, the main signal as a time-domain signal is transformed into a frequency-domain signal by a filter bank using Equation (7). Thereafter, processing is the same as that performed by the pitch characteristic decision unit 326*b* of the third embodiment.

$$QMD[k][n]=\exp\left[j\frac{\pi}{128}(k+0.5)(2n+1)\right],\quad 0\leq k<64,\ 0\leq n<128 \tag{7}$$

The residual band decision unit 90 determines a bandwidth (or a residual band) of low-frequency components of the residual signal to be encoded, based on results obtained by the pitch characteristic decision unit 88. A residual band decision method involves setting a small bandwidth as the residual band when the pitch characteristic is equal to or more than the threshold value TH_pitch, or setting the full band of the residual signal as the residual band when the pitch characteristic is less than TH_pitch. TH_pitch is the threshold value, which may be set equal to 0.8, for example. Incidentally, for a small residual band, a low frequency band equal to or lower than a frequency equivalent to ½ of Nyquist frequency, for example, may be set as the residual band. Also, the residual band is determined so as to be consistent with a source frequency band and a target frequency band indicated by the auxiliary information, taking it into account that, at the time of decoding, the auxiliary information for the main signal is used to generate a highband residual signal from a lowband residual signal.

The encoder 92 encodes the residual band of the residual signal generated by the residual signal generator 86, determined by the residual band decision unit 90, thereby to output residual code.

The multiplexer 82 multiplexes the main signal code and the auxiliary information code outputted by the main signal encoder 80, and the residual code outputted by the encoder 92, thereby to produce and output coded data.

Figure 18:
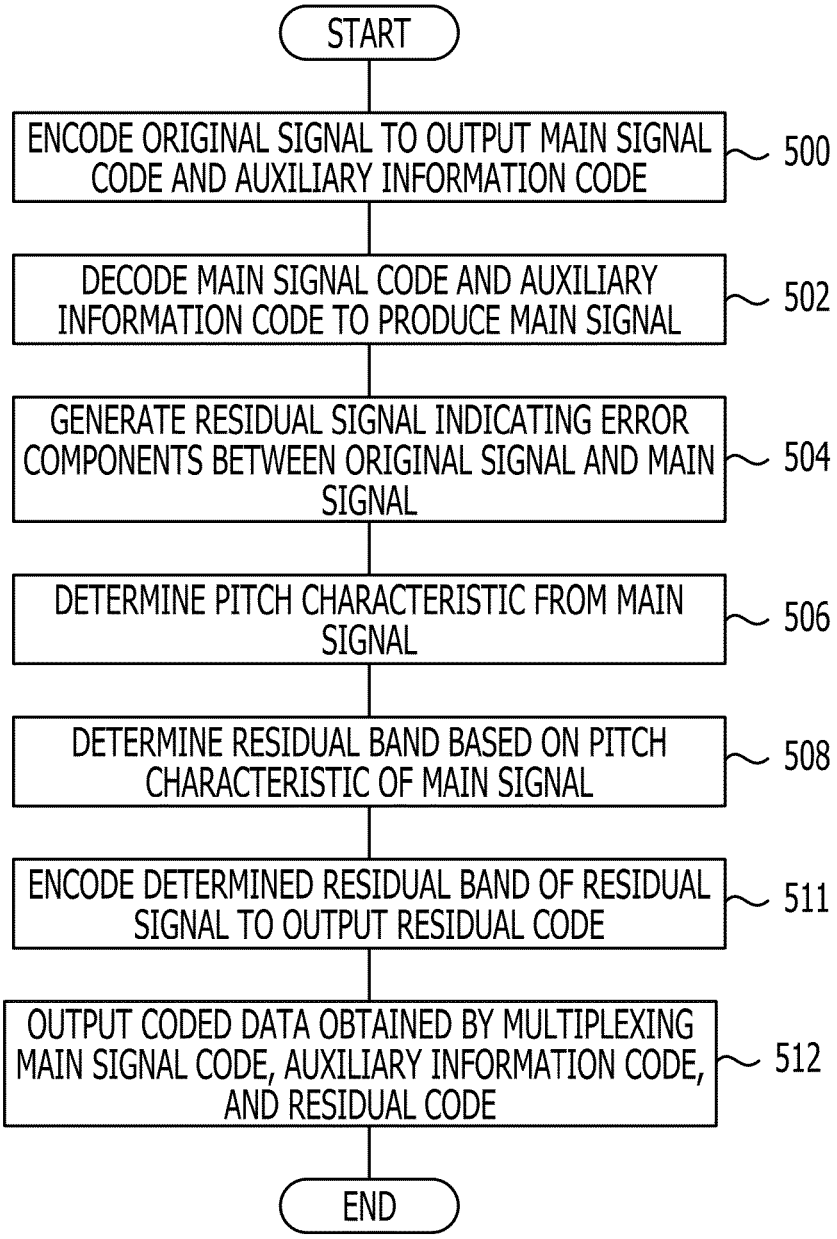
FIG. 18 is a flowchart illustrating details of an encoding process of the fifth embodiment.
Figure 19:
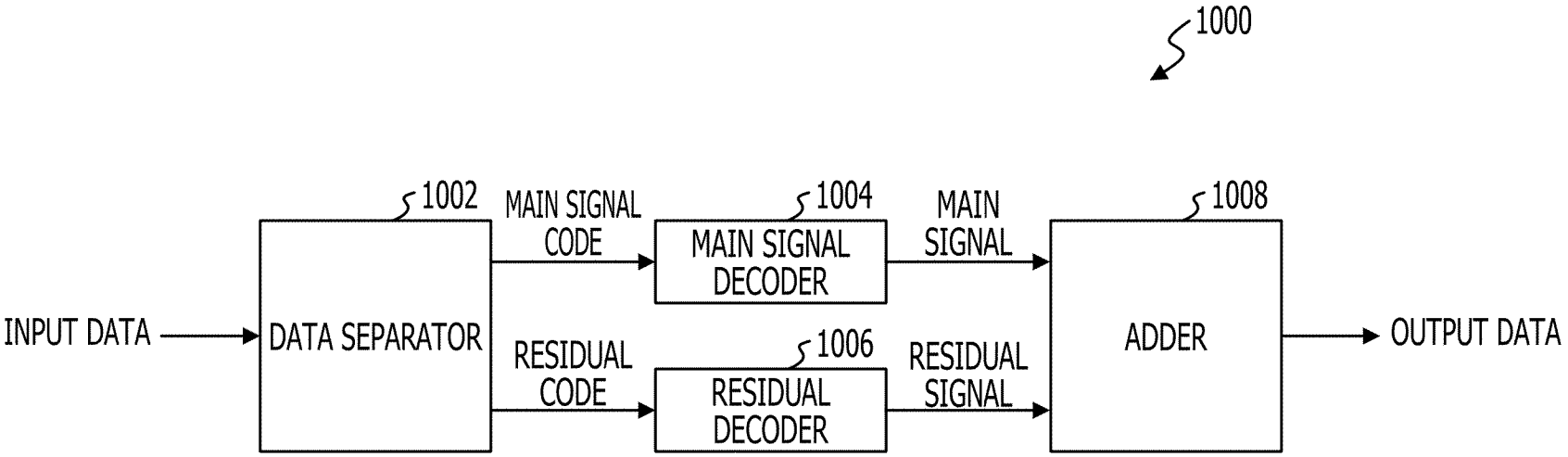
FIG. 19 RELATED ART
FIG. 19 is a functional block diagram illustrating an example of a decoding device of the related art.
Figure 20:
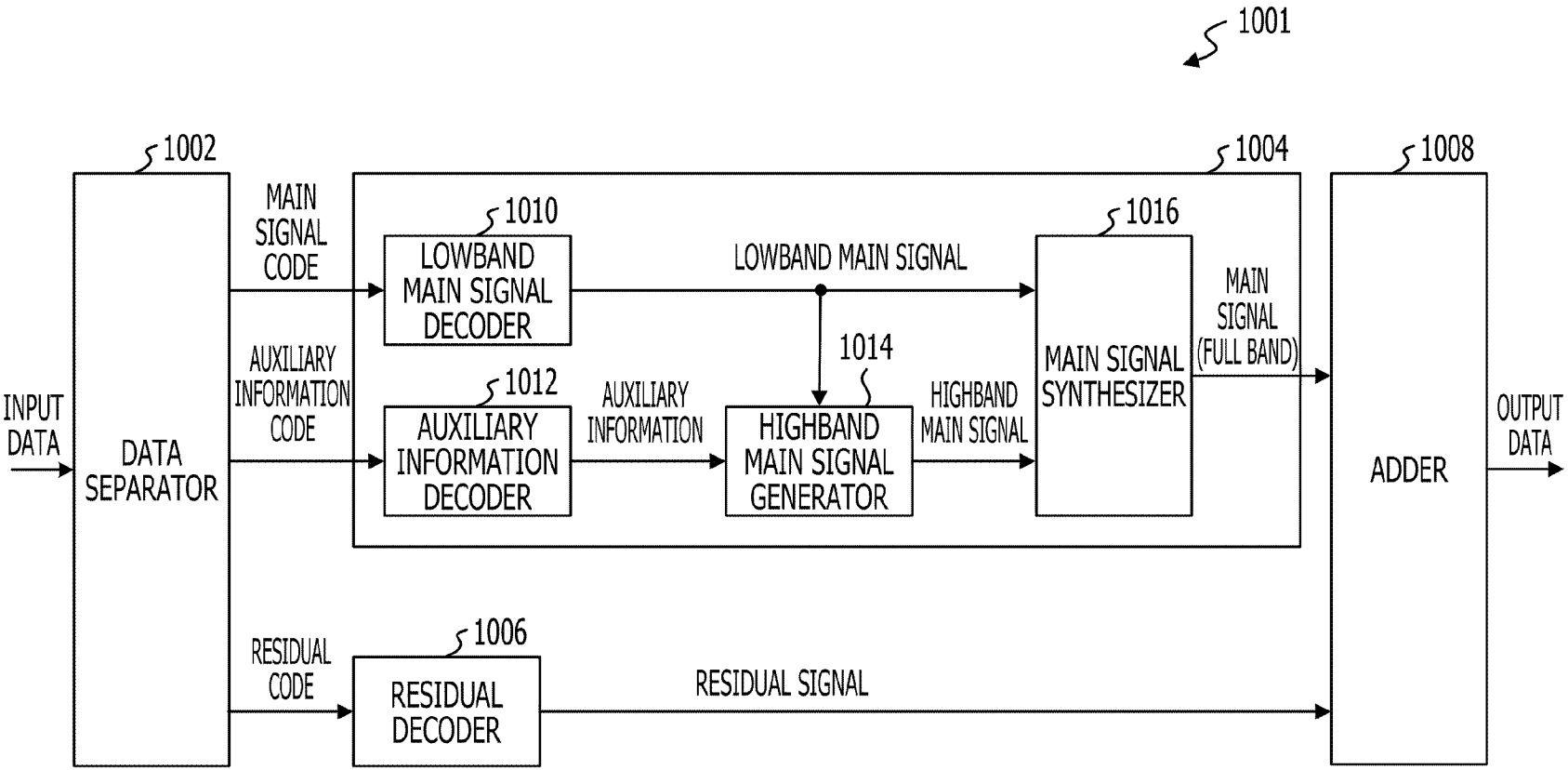
FIG. 20 RELATED ART
FIG. 20 is a functional block diagram illustrating another example of a decoding device of the related art.
Figure 21:
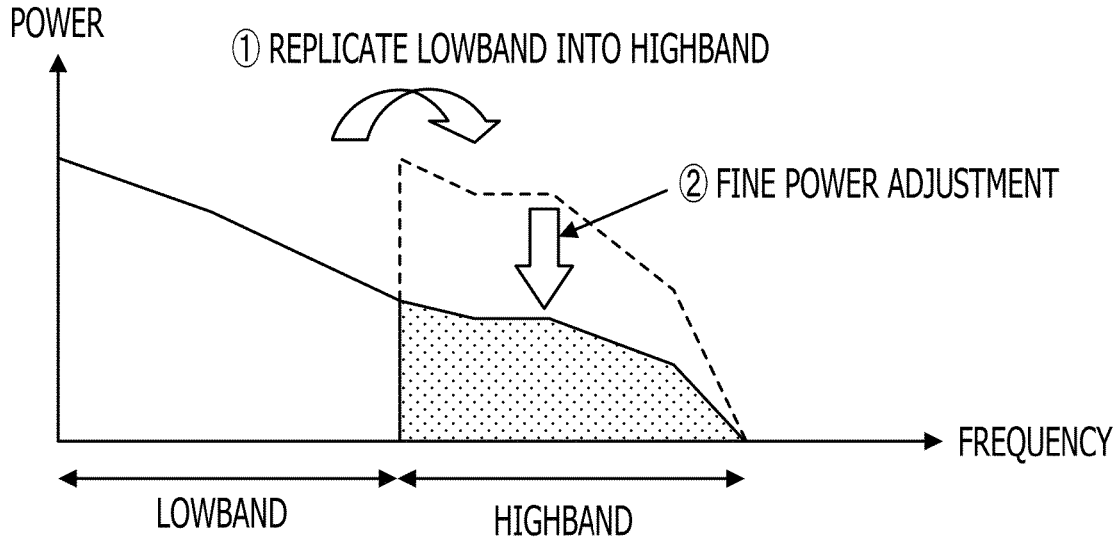
FIG. 21 is a schematic representation of assistance in explaining generation of a highband residual signal of the related art.

Next, description will be given with reference to FIG. 18 with regard to an encoding process performed by the encoding device 510 of the fifth embodiment.

At step 500, the main signal encoder 80 encodes an original signal by the HE-AAC to output main signal code and auxiliary information code.

Then, at step 502, the main signal decoder 84 decodes the main signal code and the auxiliary information code encoded by the main signal encoder 80, thereby to output a main signal.

Then, at step 504, the residual signal generator 86 generates a residual signal indicating error components between the original signal and the main signal outputted by the main signal decoder 84.

Then, at step 506, the pitch characteristic decision unit 88 transforms the main signal as a time-domain signal decoded by the main signal decoder 84, into a frequency-domain signal, and then determines a pitch characteristic of the main signal.

Then, at step 508, the residual band decision unit 90 sets a small bandwidth as the residual band when the pitch characteristic determined by the pitch characteristic decision unit 88 are equal to or more than the threshold value TH_pitch, or sets the full band of the residual signal as the residual band when the pitch characteristic is less than TH_pitch.

Then, at step 511, the encoder 92 encodes the residual band of the residual signal generated by the residual signal generator 86, determined by the residual band decision unit 90, thereby to output residual code.

Then, at step 512, the multiplexer 82 multiplexes the main signal code and the auxiliary information code outputted by the main signal encoder 80, and the residual code outputted by the encoder 92, thereby to produce and output coded data, and then the encoding process comes to an end.

The output coded data is decoded by the decoding device of any one of the above-described first to fourth embodiments. At this time, if the full band of the residual signal is encoded, the process for generating a highband residual signal from a lowband residual signal is omitted from the decoding process.

As described above, when the pitch characteristic of the main signal is equal to or more than the threshold value TH_pitch, the low-frequency components alone of the residual signal also are encoded, and thereby, a reduction in the bit rate may be achieved. Also, when the pitch characteristic of the main signal is less than the threshold value TH_pitch, the full band of the residual signal is encoded, and thereby, degradation in output data produced by decoding coded data may be suppressed.

Incidentally, in the fifth embodiment, description has been given with regard to an instance where the residual band is determined based on the pitch characteristic of the main signal; however, a predetermined low frequency band of the residual signal may be set as the residual band without determining the pitch characteristic. For example, the same low frequency band as a low frequency band of the main signal to be encoded may be set as the residual band.

Also, although the decoding devices have been described with reference to the first to fourth embodiments and the encoding device has been described with reference to the fifth embodiment, an encoding/decoding system including the decoding device of any one of the first to fourth embodiments and the encoding device of the fifth embodiment may be configured.

Also, the decoding program 58 or the encoding program 558 has been described above as being prestored (or preinstalled) in the storage unit 46 but is not so limited. For example, the decoding program in the technologies disclosed herein may also be provided in a form recorded on a storage medium such as a CD-ROM or a DVD-ROM.

Also, each of the decoding devices and the encoding device in the technologies disclosed herein may be configured as hardware to cause the units to implement the processes.

All documents, patent applications and technological standards described herein are incorporated herein by reference to the same extent as specific and separate descriptions of separate documents, patent applications and technological standards as incorporated by reference.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A decoding device to decode a main signal code obtained by encoding low-frequency components of an original signal and to output a lowband main signal for output of a main signal, comprising:

a processor; and a memory which stores a plurality of instructions, which when executed by the processor, cause the processor to execute, decoding auxiliary information code obtained by encoding auxiliary information, the auxiliary information being for generating, from the lowband main signal, a highband main signal corresponding to high-frequency components of the original signal;

decoding residual code obtained by encoding low-frequency components of a residual signal indicating error components produced by encoding of the original signal, and thereby output a lowband residual signal;

generating a highband residual signal indicating high-frequency components of the residual signal, based on the lowband residual signal output by the residual decoder and the output auxiliary information;

generating an output signal based on the main signal, the lowband residual signal and the highband residual signal.

2. The device according to claim 1, wherein the generating the highband residual signal generates the highband residual signal by replicating a signal contained in a predetermined band of the lowband residual signal determined based on the auxiliary information, into a highband, and adjusting a level of the replicated signal based on a level of the lowband main signal and a level of the lowband residual signal.

3. The device according to claim 2, wherein the generating the highband residual signal corrects a level of the generated highband residual signal such that the level of the highband residual signal is attenuated with increasing frequency.

4. The device according to claim 1, wherein the generating the highband residual signal generates the highband residual signal, when a pitch characteristic of at least any one of the lowband main signal, the highband main signal, the main signal, and the lowband residual signal is higher than a predetermined threshold value.

5. The device according to claim 4, wherein the generating the highband residual signal determines the pitch characteristic by calculating a maximum value of a frequency-base autocorrelation of at least any one of the lowband main signal, the highband main signal, the main signal, and the lowband residual signal.

6. An encoding device for encoding an original signal, comprising:

a processor; and a memory which stores a plurality of instructions, which when executed by the processor, cause the processor to execute, outputting main signal code obtained by encoding low-frequency components of the original signal, and auxiliary information code obtained by encoding auxiliary information for generating a highband main signal corresponding to high-frequency components of the original signal, from a lowband main signal obtained by decoding the main signal code; and outputting residual code obtained by encoding low-frequency components of a residual signal indicating error components produced by encoding of the original signal, the auxiliary information with the high-frequency components of the original signal usable to generate a highband residual signal from a lowband residual signal from the residual code.

7. The device according to claim 6, wherein the outputting the residual code determines a bandwidth of the low-frequency components of the residual signal to be encoded, based on a pitch characteristic of a main signal obtained by decoding the main signal code and the auxiliary information code outputted by the outputting the main signal.

8. A decoding method to decode a main signal code obtained by encoding low-frequency components of an original signal, the method comprising:

decoding the main signal code obtained by the encoding low-frequency components of the original signal, and thereby outputting a lowband main signal;

decoding auxiliary information code obtained by encoding auxiliary information for generating a highband main signal corresponding to high-frequency components of the original signal, from the lowband main signal, and thereby outputting the auxiliary information;

decoding residual code obtained by encoding low-frequency components of a residual signal indicating error components produced by encoding of the original signal, and thereby output a lowband residual signal;

generating, by a processor, the highband main signal based on the lowband main signal outputted by the outputting of the lowband main signal and the auxiliary information outputted by the outputting of the auxiliary information;

generating a highband residual signal indicating high-frequency components of the residual signal, based on the lowband residual signal output by the outputting of the lowband residual signal and the auxiliary information outputted by the outputting of the auxiliary information;

generating an output signal based on the lowband main signal, the highband main signal, the lowband residual signal and the highband residual signal.

9. The method according to claim 8, wherein the generating of the highband residual signal includes generating the highband residual signal by replicating a signal contained in a predetermined band of the lowband residual signal determined based on the auxiliary information, into a highband, and adjusting a level of the replicated signal based on a level of the lowband main signal and a level of the lowband residual signal.

10. The method according to claim 9, wherein the generating of the highband residual signal includes correcting a level of the generated highband residual signal such that the level of the highband residual signal is attenuated with increasing frequency.

11. The method according to claim 8, wherein the generating of the highband residual signal includes generating the highband residual signal, when a pitch characteristic of at least any one of the lowband main signal, the highband main signal, the main signal, and the lowband residual signal is higher than a predetermined threshold value.

12. The method according to claim 11, wherein the generating of the highband residual signal includes determining the pitch characteristic by calculating a maximum value of a frequency-base autocorrelation of at least any one of the lowband main signal, the highband main signal, the main signal, and the lowband residual signal.

* * * * *